United States Patent [19]

Manning et al.

[11] 4,074,628

[45] Feb. 21, 1978

[54] FAX CANISTER WITH A BOTTOM BURSTER CHARGE AND DISPERSION CONTROL RING

[75] Inventors: Larry G. Manning, Ridgecrest, Calif.; Richard J. Zabelka, Brimley, Mich.

[73] Assignee: The United States of America as represented by the Secretary of the Navy, Washington, D.C.

[21] Appl. No.: 560,377

[22] Filed: June 21, 1966

[51] Int. Cl.[2] ..... F42B 25/12

[52] U.S. Cl. ..... 102/6; 102/7.2; 102/90

[58] Field of Search ..... 102/2, 6, 7.2, 39, 65, 102/66, 90

*Primary Examiner*—David H. Brown

*Attorney, Agent, or Firm*—R. S. Sciascia; Roy Miller

[57] ABSTRACT

Cylindrical canister for producing a frusto-conical aerosol explosive cloud, having a frangible upper wall portion which fails first, producing a generally pancake shaped cloud, and a thickened control ring surrounding its lower wall portion which fails last, producing an upward and outward component to the pancake cloud.

1 Claim, 1 Drawing Figure

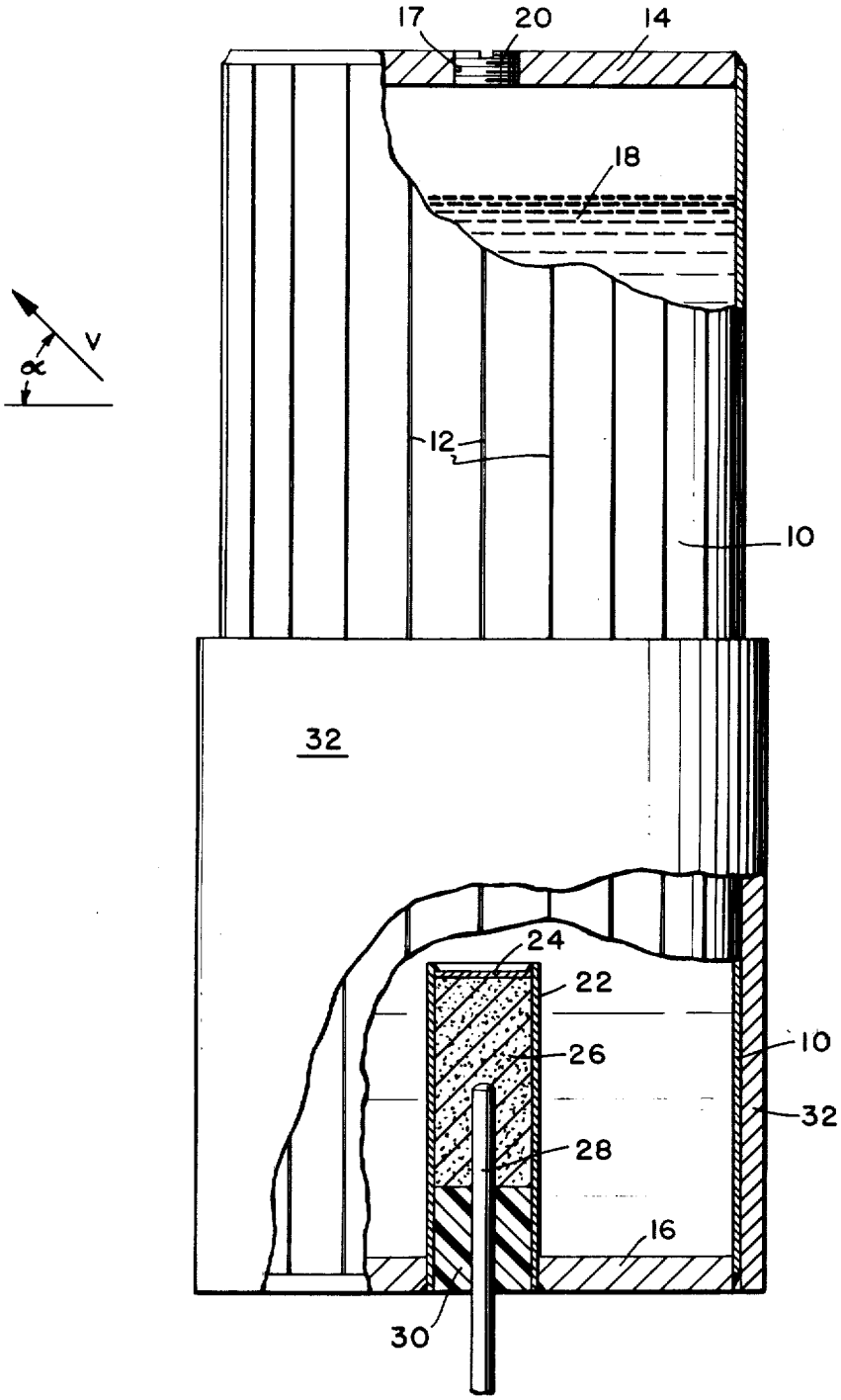
INVENTORS.
LARRY G. MANNING
RICHARD J. ZABELKA
BY
V. C. MULLER
ROY MILLER
ATTORNEYS.

FAX CANISTER WITH A BOTTOM BURSTER CHARGE AND DISPERSION CONTROL RING

The invention described herein may be manufactured and used by or for the Government of the United States of America for governmental purposes without the payment of any royalties thereon or therefor.

This invention relates to improvements in the formation of explosive aerosol clouds employed in warfare.

In the prior art it has been the practice to drop from aircraft, canisters of fuel which are dispersed by an explosive device, usually adjacent the ground, into aerosol clouds which are detonated when the proper fuel-air mixture is attained. Intended targets may be personnel, parked aircraft, vehicles, buildings and the like. A device of this type, sometimes referred to as a FAX canister, is exemplified by the patent application of William A. Gey, Ser. No. 173,077, filed Feb. 13, 1962. In said application a central burster tube is employed to disperse the surrounding material contained within the canister.

It has been found that the prior art canister referred to, while satisfactory in large FAX devices does not produce optimum lethal clouds when it is reduced in size with its attendant reduction in fuel quantity, thus rendering it impracticable when used in small bomblet cluster type weapons and which appears to be attributable to insufficient cloud thickness resulting from the center burster charge.

One of the objects of this invention is to produce optimum aerosol cloud thickness with a minimum quantity of fuel.

Another object is to provide a construction with which cloud shape may be varied.

Another object is to produce a generally frusto-conical cloud, in contradistinction to a generally flat or pancake shaped cloud.

Another object is to provide a canister which ruptures in two stages, the second stage producing a velocity component acting upon the first stage.

Still further object, advantages, and salient features will become more apparent from the description to follow, the appended claims, and the accompanying drawing, in which:

The single FIGURE is a side elevation of the subject of the invention, portions being broken away and shown in section.

Referring now to the drawing, the subject of the invention comprises a metallic tube 10, having a plurality of angularly-spaced longitudinally extending weakening grooves 12 in its outer surface, and walls 14, 16, of considerably greater thickness, welded to its opposite ends. One end wall, such as wall 14, is provided with a threaded opening 17, through which fuel 18 may be introduced, and a plug 20 for closing the opening.

A burster tube 22, having a welded end wall 24, is welded to end wall 16, the tube containing a high explosive material 26 such as C-3, and a detonator 28. The explosive material may be sealed within the tube by any suitable material 30, such as styrafoam. While not shown, tube 22 may be provided with angularly spaced weakening grooves, like grooves 12.

A metallic dispersion control ring 32, of considerably greater wall thickness than tube 10, is cemented to the latter and serves to control the manner in which the canister ruptures, as will be subsequently described.

In a construction found to yield the desired results, tube 10 was constructed of seamless aluminum 6061-T6 of 0.065 inch wall thickness with 0.025 inch thick end walls, overall dimensions being 4.00 inches in diameter and 10.00 inches in length. 24 equally spaced 45° weakening grooves, with a depth of 0.020 inch, were provided in its outer wall. The burster tube was of the same material as tube 10, its wall thickness being 0.035 inch and containing 0.70 pounds of C-3 propellant. The length of the burster tube was approximately ⅓ the length of the canister. The dispersion control ring, about half the length of the canister, was constructed of steel having a wall thickness of about 0.240 inch.

In operation, the canisters are dropped from aircraft in clusters and fall in a substantially vertical direction with the burster tube at the bottom. Stabilizing fins (not shown) or fins on a canister carrier may be employed to ensure that the canisters fall as desired. When they reach the desired position above the target, usually close to ground level, the detonators are actuated by a suitable fuse (not shown) such as a proximity fuse. Upon detonation, the canister first fails between the upper edge of the control ring and the upper end wall. The fuel is dispersed radially outward in a generally pancake pattern, as in the prior art, but the control ring next fails is somewhat funnel shape, its upper end opening to a greater extent than its lower end. This produces an upward and outward component V at an angle $\alpha$ (of about 45°) which acts upon the outwardly moving liquid to provide an overall result of an inverted generally frusto-conical cloud of fuel. Adjacent clouds then mingle and when the proper air to fuel ratio is reached the cloud is detonated by an explosive charge in conventional manner.

Obviously many modifications and variations of the present invention are possible in the light of the above teachings. It is therfore to be understood that within the scope of the appended claims the invention may be practiced otherwise than as specifically described.

What is claimed is:

1. Apparatus for dispersing fuel into the atmosphere for mixing therewith to produce an explosive cloud, comprising:

(a) a cylindrical canister having upper and lower non-failing end walls, adapted to be oriented in the air with its longitudinal axis in a generally vertical direction, (b) a burster tube disposed adjacent the lower end wall and extending part way the length of the canister, said burster tube containing a high explosive adapted to produce a shock wave when detonated, (c) a dispersion control ring surrounding the canister and extending from the lower wall to about the mid-portion of the canister, and (d) a fuel contained within the canister and substantially filling the same, (e) the construction and arrangement being such that when the detonator is actuated the canister first fails radially in the portion above the control ring and next fails, together with the control ring, therebelow, whereby the second named failure produces upwardly and outwardly components, producing a fuel cloud of inverted generally frusto-conical shape.

* * * * *